United States Patent [19]

Sando et al.

[11] 4,087,993

[45] May 9, 1978

[54] HEAT FULLING AND WATER WASHING APPARATUS

[75] Inventors: Yoshikazu Sando; Hiroshi Ishidoshiro, both of Wakayama, Japan

[73] Assignee: Sando Iron Works Co., Ltd., Japan

[21] Appl. No.: 784,329

[22] Filed: Apr. 4, 1977

Related U.S. Application Data

[63] Continuation of Ser. No. 628,495, Nov. 3, 1975, abandoned, which is a continuation of Ser. No. 478,749, Jun. 12, 1974, abandoned.

[51] Int. Cl.[2] ..... D06B 3/20

[52] U.S. Cl. ..... 68/18 R; 68/22 R; 68/62; 68/158; 68/177; 68/207

[58] Field of Search ..... 68/43, 44, 62, 148, 68/158, 175, 177, 181 R, 183, 184, 205 R, 207, DIG. 5, 22 R, 18 R; 26/20, 21

[56] References Cited

U.S. PATENT DOCUMENTS

| | | | |
|---|---|---|---|
| 2,724,955 | 11/1955 | Spooner | 68/158 |
| 3,470,571 | 10/1969 | Hrboticky | 68/205 R X |
| 3,631,692 | 1/1972 | Garzotto | 68/62 |
| 3,729,958 | 5/1973 | Christian et al. | 68/22 R X |
| 3,958,288 | 5/1976 | von der Eltz et al. | 68/158 X |

FOREIGN PATENT DOCUMENTS

| | | | |
|---|---|---|---|
| 467,128 | 8/1950 | Canada | 68/158 |
| 581,070 | 7/1933 | Germany | 68/158 |
| 15,792 | 8/1963 | Japan | 68/183 |
| 18,047 | 6/1970 | Japan | 68/175 |

*Primary Examiner*—Philip R. Coe

*Attorney, Agent, or Firm*—Toren, McGeady and Stanger

[57] ABSTRACT

In a heat fulling and water washing apparatus hot fluid is injected onto both surfaces of cloth from hot fluid injection nozzles being placed in upper and lower rows to sandwich the passing path of the cloth in such manner that the positions of nozzles in the upper row alternate with those of nozzles in the lower row, in a process of passing cloth through an opening between upper and lower net conveyors in such state as immersing the cloth in cleaning liquid, so that both cleansing effect and fulling effect are given to the cloth.

2 Claims, 2 Drawing Figures

HEAT FULLING AND WATER WASHING APPARATUS

This is a continuation of application Ser. No. 628,495 filed on Nov. 3, 1975, which, in turn, is a continuation of application Ser. No. 478,749, filed June 12, 1974, both now abandoned.

BRIEF SUMMARY OF THE INVENTION

The present invention relates to a hot fulling and water washing apparatus which is characterized by that hot fluid is injected onto both surfaces of cloth from hot fluid injection nozzles being placed at upper and lower rows which sandwitch the passing path of said cloth in such manner that the positions of the nozzles in the upper row are alternated with those of nozzles in the lower rows, in a process of passing the cloth through an opening between upper and lower net conveyors in such state as immersing the cloth in cleaning liquid, so that both cleansing effect and fulling effect are given to the cloth.

How, the apparatus will be explained by an example shown in the drawings.

DETAILED DESCRIPTION OF THE DRAWING

Figure 1:
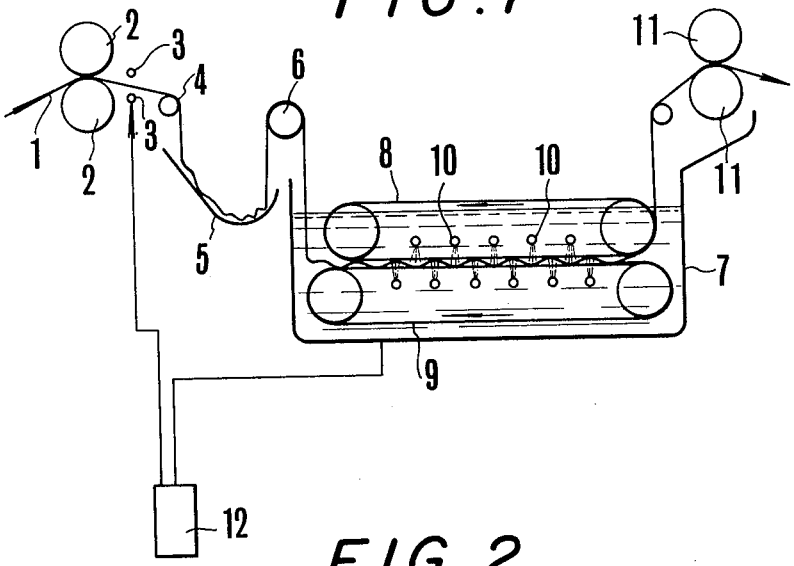
Figure 2:
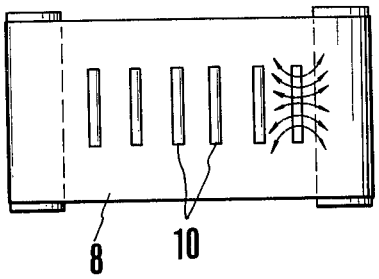

FIG. 1 is a schematic side view of the apparatus of the present invention; and FIG. 2 is a partial plan of the same.

The cloth 1 which has been subjected to securing, bleaching and other processes is sent through squeezing rolls 2 and is washed by shower water with shower pipes 3, then is stagnated at a piler 5 after going through a guide roll 4.

The cloth 1, which has been stagnated there until the rinsing and fulling processes have been completed, is sent into a water washing tank 7 through a feeder roll 6.

FIG. 9 are upper and lower net conveyors opposingly provided having a narrow opening therebetween, wherein said conveyors are so positioned that at least the opening is immersed in the liquid in the water washing tank 7.

Pipes 10 which inject fluid (hot water, steam, or hot air) are provided in an alternate manner at upper and lower positions relative to a cloth passing path which is the above mentioned narrow opening, so that hot fluid is injected onto the both surfaces of the cloth.

The cloth will be moved forward with no tension working thereon while it is being struck by the injected fluid and pushed against the upper and lower net conveyors in a waveform, thus water washing and fulling are given to the cloth simultaneously.

At this time if pipes 10 are made shorter than the width of the cloth 1, the cloth will also receive an expanding effect by such jet streams as shown in FIG. 2 (note the directions shown by arrow marks).

Then the cloth 1 is pulled up and is guided out of the water washing tank 7 via squeezing rolls 11.

12 is a purification tank, in which waste water from the water washing tank 7 is purified and then the purified water is resupplied to the shower unit 3.

What is claimed is:

1. A heated fulling and water washing apparatus comprising a washing tank containing a cleaning fluid and having a liquid level therein, means for conveying cloth to said washing tank including squeezing rolls, a guide roll located between said squeezing rolls and said washing tank, a feeder roll located above said washing tank and positioned between said guide roll and said washing tank, a piler located between said guide roll and said feeder roll and spaced below said guide roll and feed roll and arranged to accumulate cloth for passage into said washing tank in an untensioned state, a first conveyor means and a second conveyor means located in said washing tank, said first conveyor means comprising a pair of first rollers having their axes arranged horizontally and being spaced apart in a horizontal direction; and an endless first net conveyer trained over said first rollers and said first net conveyer having a horizontally extending upper run and a horizontally extending lower run spaced below the upper run, said second conveyer means comprising a pair of second rollers having their axes arranged horizontally and being spaced apart in the horizontal direction, said second rollers being located below said first rollers, and a second net conveyer trained over said second rollers and said second net conveyer having a horizontally extending upper run and a horizontally extending lower run spaced below the upper run thereof, the lower run of said first net conveyer being spaced above the upper run of said second net conveyer and forming therebetween a horizontally extending space arranged for the passage therethrough of a cloth to be treated moving generally in a horizontal direction between the rollers of said first and second net conveyers, the lower surface of the lower run of said first net conveyer and the upper surface of the upper run of said second conveyer each being located below the liquid level in said washing tank and each forming a contact surface for the cloth being treated so that as the cloth moves in contact with the surface of one said conveyer it is spaced from the other said conveyer with the vertical space between the two contact surfaces being sufficient for the cloth to adapt a wave form shape as it moves between and in contact with the surfaces, a plurality of horizontally extending first fluid injection pipes disposed in horizontally spaced relation and located between the upper and lower runs of said first net conveyer with the axes of said pipes disposed in parallel relation with the axes of the rollers of said first conveyer means, said first fluid injection pipes having downwardly direct nozzles for directing hot fluid downwardly through the lower run of the first net conveyer into the space between the first and second net conveyers, a plurality of horizontally arranged second fluid injection pipes disposed in horizontally spaced relation and located between the upper and lower runs of said second net conveyer with the axes of said second pipes disposed in parallel relation with the axes of the rollers of said second conveyer means, said second fluid injection pipes having upwardly directed nozzles for directing hot fluid upwardly through the upper run of said second net conveyer into the space between the first and second net conveyers, said first and second fluid injection pipes being arranged in an alternating manner along the path of the cloth through the space between said first and second net conveyers so that the cloth being treated receives alternating sprays on its upper and lower surfaces as it moves in the horizontal direction through the space between said first and second net conveyers whereby the sprays impart a wave-like configuration to the cloth as it moves through the space without any tension being exerted on the cloth in its direction of movement through the space, and the axial length of each of said first and second fluid injection pipes being shorter than the transverse width of said first and second net conveyers and being spaced inwardly from the edges of said first and second net conveyers so that the cloth passing through the space between said first and second net conveyers receives a spray directed from said first and second fluid injection pipes for affording an expanding effect to the cloth being treated.

2. A heat and fulling water washing apparatus, as set forth in claim 1, comprising a preliminary cleaning device located in the path of the cloth as it moves toward the space between said first and second net conveyers for showering a portion of the cleaning fluid onto the cloth prior to its passage through the space, and means connected to said washing tank and to said preliminary cleaning device for receiving waste fluid from said washing tank and for purifying the fluid from said washing tank and for purifying the fluid for use in said preliminary cleaning device.

* * * * *